United States Patent [19]

Rossow

[11] 4,400,043

[45] Aug. 23, 1983

[54] COLLAPSIBLE STORAGE CABINET

[76] Inventor: Robert W. Rossow, 89 Hazardville Rd., Longmeadow, Mass. 01106

[21] Appl. No.: 261,370

[22] Filed: May 7, 1981

[51] Int. Cl.[3] ..... A47B 5/00

[52] U.S. Cl. ..... 312/111; 312/3; 312/6; 108/149

[58] Field of Search ..... 312/111, 108, 1, 3, 312/4, 5, 6, 297; 108/110, 149

[56] References Cited

U.S. PATENT DOCUMENTS

| | | | |
|---|---|---|---|
| 315,760 | 4/1885 | Garrison | 312/5 |
| 900,495 | 10/1908 | Dodson . | |
| 1,411,272 | 4/1922 | Eaton | 312/6 |
| 1,670,026 | 5/1928 | De Lano | 312/6 |
| 1,984,827 | 12/1934 | Derman | 312/4 |
| 2,011,962 | 8/1935 | Wheatley | 312/111 |
| 2,107,828 | 2/1938 | Krantz . | |
| 2,244,887 | 6/1941 | Manley | 108/149 |
| 2,633,998 | 4/1953 | Derman | 108/149 |
| 3,094,361 | 6/1963 | Poyer . | |
| 3,519,318 | 7/1970 | Hagen . | |
| 3,904,258 | 9/1975 | Faulkenberry . | |
| 4,059,248 | 11/1977 | Kuntz | 108/149 |
| 4,082,389 | 4/1978 | Stewart . | |
| 4,108,084 | 8/1978 | Fink | 108/149 |

FOREIGN PATENT DOCUMENTS

| | | | |
|---|---|---|---|
| 433633 | 9/1967 | Switzerland | 312/111 |
| 5266 | of 1902 | United Kingdom | 312/4 |

*Primary Examiner*—Victor N. Sakran

*Attorney, Agent, or Firm*—Chapin, Neal, Dempsey, Fishman & Dionne

[57] ABSTRACT

A knockdown, but sturdy, cabinet for campers is disclosed. The cabinet can be quickly assembled at a campsite by first attaching a pair of sidewalls to the inside of a weatherproof covering so that the sidewalls are spaced apart and parallel to one another. The sidewalls have opposed inner surfaces with transverse grooves so that a plurality of shelves can then be slid between the sidewalls and into the grooves to complete the cabinet. When breaking camp, the cabinet can be easily broken down by sliding the shelves out of the grooves and then detaching the covering from the sidewalls. The shelves, sidewalls and covering can then be stacked and stored in a small box so as to take up little space during the trip home.

3 Claims, 5 Drawing Figures

COLLAPSIBLE STORAGE CABINET

BACKGROUND OF THE INVENTION

This invention relates to collapsible storage cabinets and more particularly relates to collapsible cabinets usable by campers to hold their groceries and/or other items for handy use.

For the typical family camper, the problem of what to do with canned goods, toilet articles, children's games, utensils, salt and pepper shakers, etc., has never been really solved satisfactorily. The picnic table usually serves as the depository for these items during the day when it is not raining and the trunk or back seat of the family car gets them at night. This involves a continued shuffling of goods and often results in confusion or "lost" items.

Accordingly, the principal object of this invention is to provide campers with a weatherproof, collapsible storage cabinet that keeps goods organized, dry and easy to reach.

It is another object to provide a sturdy but collapsible cabinet that can be quickly assembled or disassembled at a campsite without the use of any tools.

It is another object to provide a collapsible cabinet that can be readiy stored in a small box that is easy to pack.

It is yet another object to provide a collapsible storage cabinet that can be easily attached to the underside of any picnic table so as to utilize the normally unused spaced under the table and also fix the cabinet in an upright position so that it cannot be accidentally tipped over.

It is yet another object to provide a collapsible storage cabinet that can be easily attached to a table either above or below the tabletop.

It is a further object to provide a collapsible cabinet, commensurate with the above-listed objects, that is simple and economical in construction, yet extremely effective to use.

The above and other objects and advantages of this invention will become more readily apparent when the following description is read in conjunction with the accompanying drawings.

DESCRIPTION OF THE PREFERRED EMBODIMENT

Figure 1:
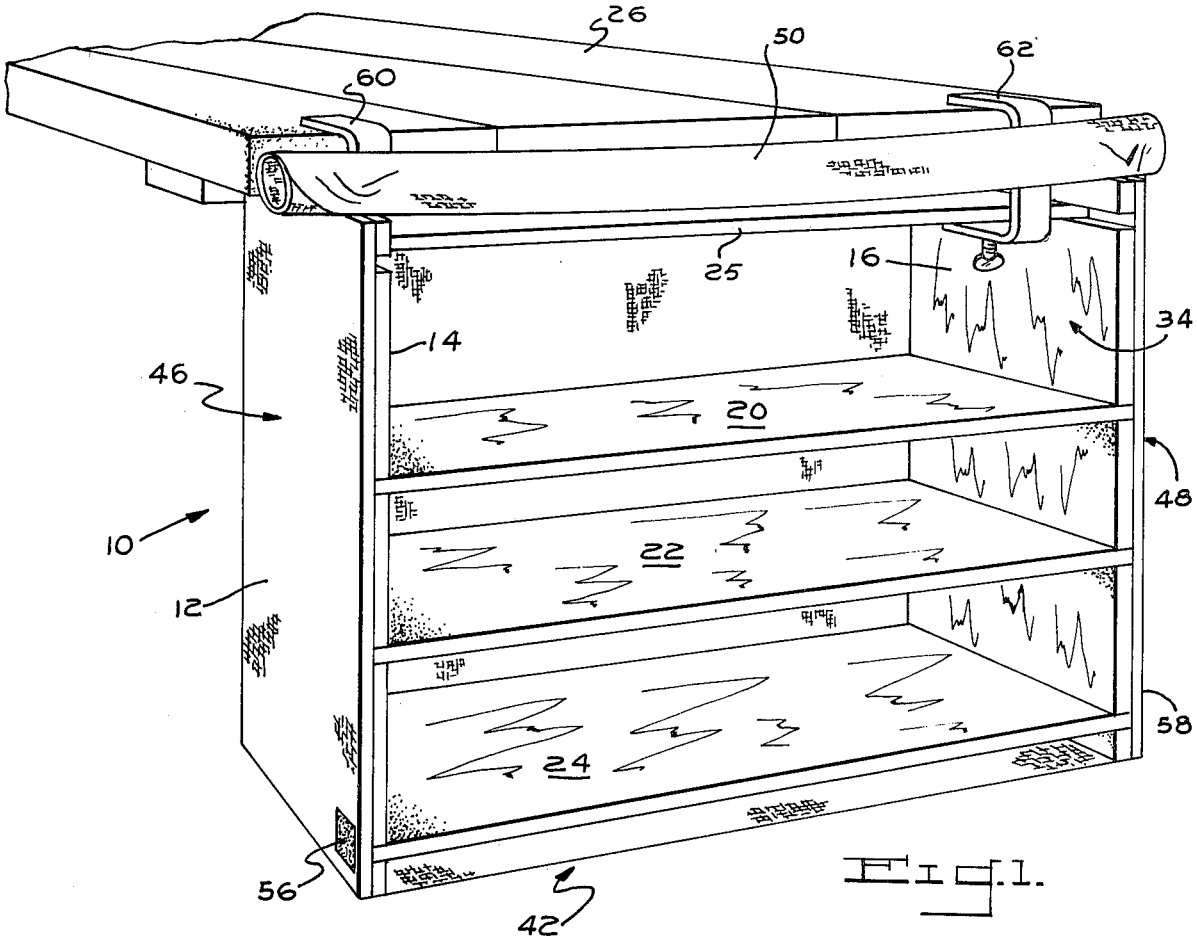
FIG. 1 is a perspective view of a collapsible storage cabinet which is constructed in accordance with the present invention and attached to the underside of a picnic table.

Referring to the drawings in detail, a collapsible cabinet 10 is shown having an outer covering 12 made of any suitable flexible material such as nylon, duck, neoprene or the like. A pair of opposed sidewalls 14, 16 are detachably connected to the inside of the covering and a plurality of shelves 20, 22, 24 are removably housed between the sidewalls. In addition, the cabinet includes a removable support ledge 25 (in the form of a top shelf) for clamping the unit to the underside of a picnic table 26 (see FIG. 1).

Figure 3:
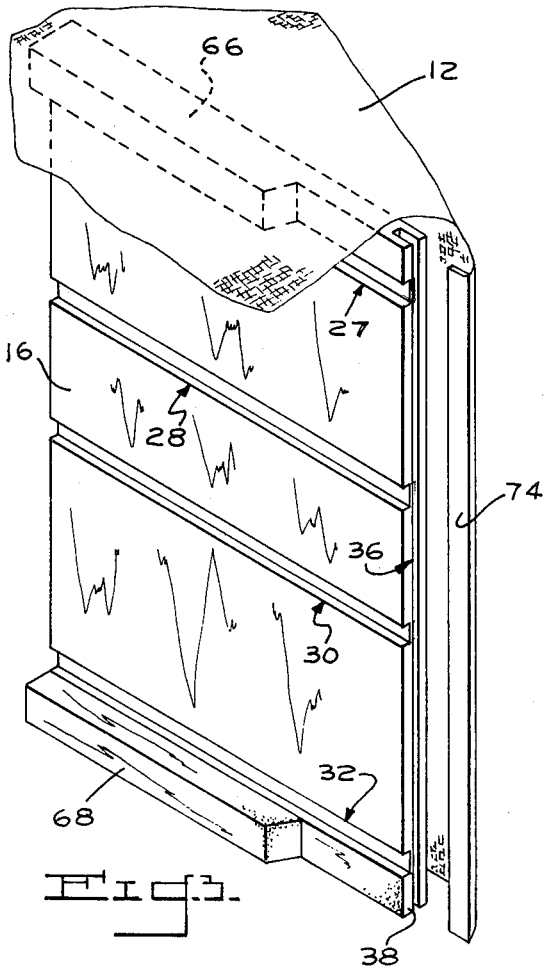
FIGS. 3–5 illustrate steps for assembling and/or disassembling the cabinet.
Figure 4:
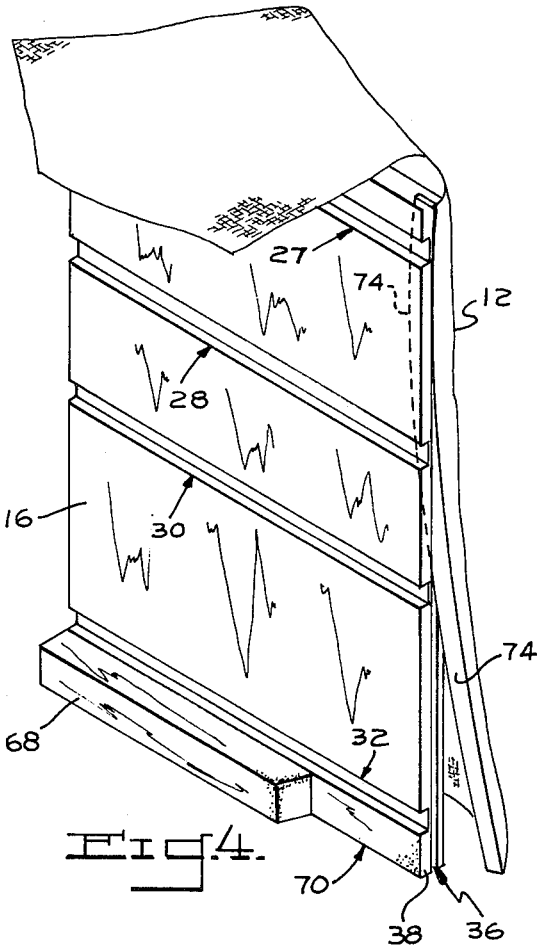

Each sidewall is substantially identical and, as best shown in FIGS. 3 and 4, has a set of transversely extending, parallel grooves 27,28 30, 32 on its inner surface 34 and a vertically extending groove 36 in a side edge 38. The sidewalls are preferably made of heavy-duty plywood but can, of course, be made of any other suitable material such as plastic or sheet metal.

The covering 12 includes top, bottom, back and side panels 40, 42, 44, 46, 48. As shown in FIG. 1, the cover also includes a front flap 50 that can be rolled up into a raised position for easy acces to the cabinet's contents and held in place by any suitable means (here, VELCRO hooks on the flap that mate with VELCRO loops on the top panel at 52, 54). When unrolled (not shown), the flap can be secured to the bottom of the sides 46, 48 (here, by VELCRO fasteners at 56, 58 that mate with the VELCRO fasteners on the flap) to keep the cabinet closed and prevent its contents from being destroyed or blown away by the elements.

In the preferred embodiment, the cover 12 includes a pair of spaced apertures in its top panel 40 (adjacent the VELCRO fasteners 52, 54), through which C-shaped clamps 60, 62 can be inserted to attach the cabinet to the underside of picnic table 26. As shown in FIG. 1, the clamps are inserted around an end of the table 26 and under the support ledge 25. Though not shown, the back side 44 of the cover also includes a pair of spaced apertures slightly above the bottom shelf 24 which enable the cabinet to be attached to the top of a picnic table by clamping the bottom shelf to the table. The unit can face either direction when mounted on the table.

Also in the preferred embodiment, a pair of horizontally extending braces 66, 68 are attached to the inner surface 34 of each sidewall 14, 16 and are flush against the top and bottom surfaces of ledge 25 and shelf 24, respectively. Brace 66 gives added support to the bottom shelf 24 and also adds stability to the cabinet since the bottom of the brace is flush against the bottom edge 70 of the sidewall and combines with the bottom edge to form a base for the cabinet. Brace 68 gives added support to the ends of ledge 25 and thereby prevents the ledge from being bowed out of shape when it is clamped to the underside of a picnic table.

Figure 2:
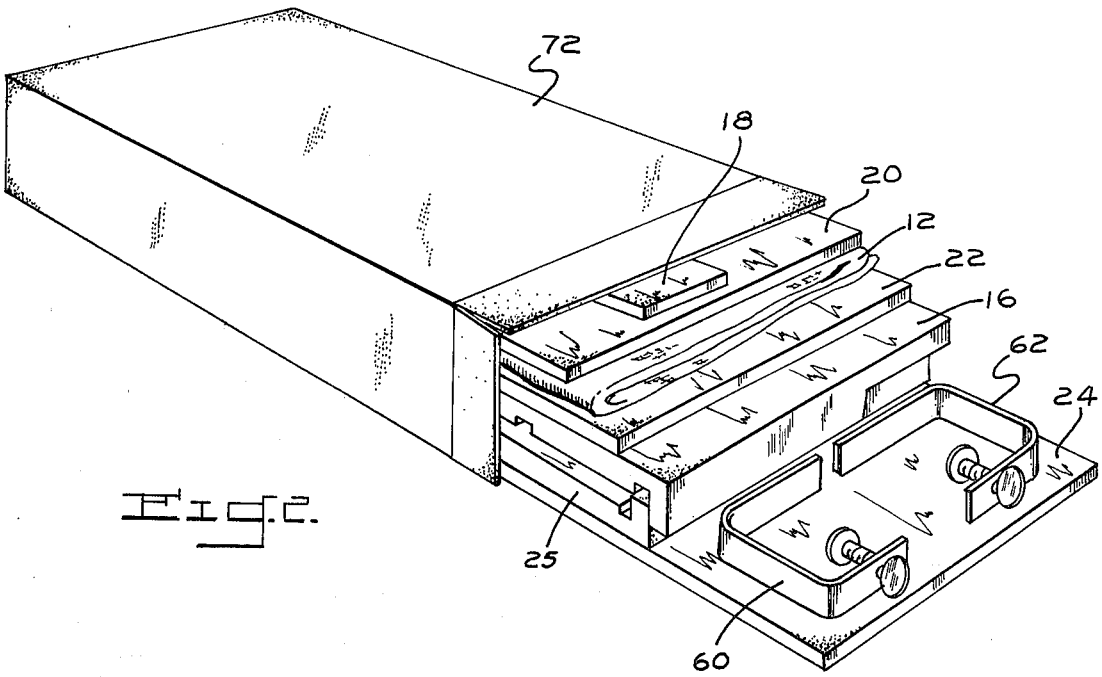
FIG. 2 is a perspective view of the cabinet after it has been broken down and stacked for storage.
Figure 5:
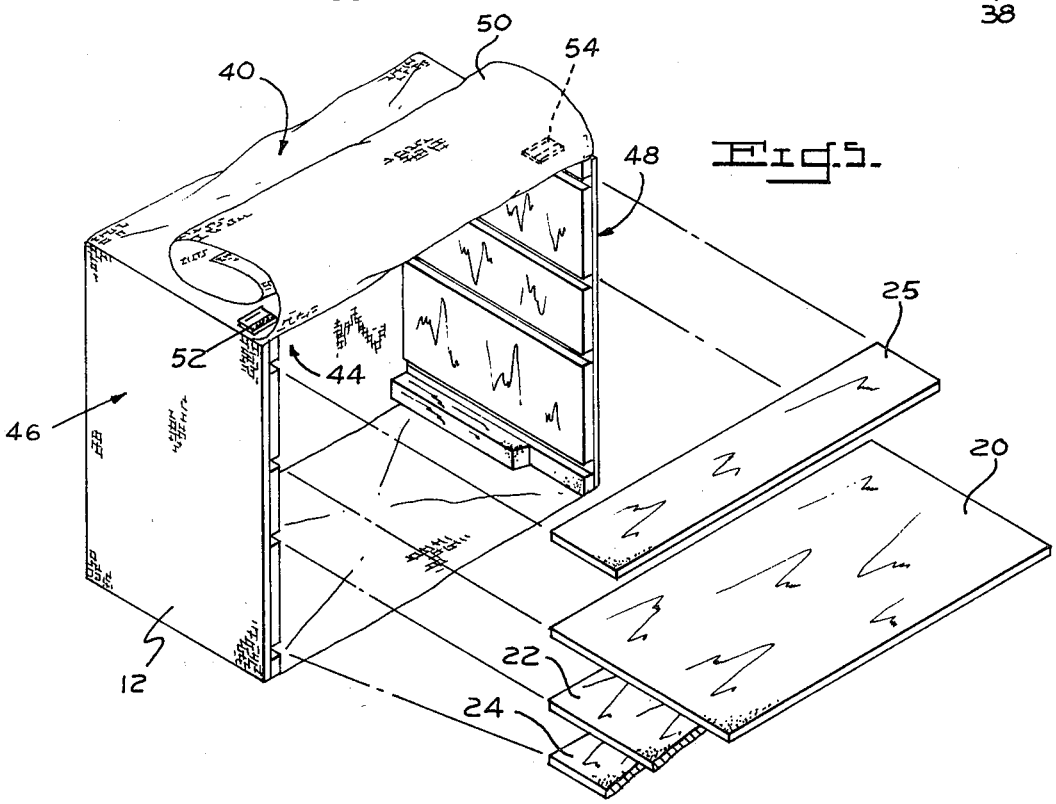

FIG. 2 shows the cabinet disassembled and stacked into a small storage box 72. To assemble the cabinet, its components are first removed from the box. The sidewalls 14, 16 are then attached to the inside of covering 12 by inserting a pair of hinge strips 74 of the covering (here, plastic strips 74 sewn to the free edge of side panels 46, 48) into the vertical grooves 36 (see FIGS. 3 and 4). After both sidewalls have been attached, the covering is slack, as shown in FIG. 5, and will remain so until one or more of the shelves or ledge 25 are slid into the grooves 27, 28, 30, 32. After the ledge and all the shelves have been inserted into the grooves, the cabinet 10 is assembled and ready for use.

To break down the cabinet, the shelves 20, 22, 24 and ledge 25 are slidably removed from between the sidewalls 14, 16 and the strips 74 are removed from the vertical grooves 36 to detach the sidewalls from the covering 12. The shelves, ledge, covering and sidewalls are then stacked in the box 72 and stored out of the way until the cabinet is needed again.

It should be apparent that obvious structural modifications can be made without departing from the scope of the invention. Accordingly, reference should be made primarily to the accompanying claims, rather than to the specification, to determine the scope of the invention.

Having thus described the invention, what is claimed is:

1. A collapsible storage cabinet comprising:
(a) a pair of sidewalls, each sidewall having a plurality of substantially transverse grooves for removably receiving a plurality of shelves;
(b) a plurality of shelves slidably receivable within said grooves;
(c) a flexible covering for the cabinet; and,
(d) attachment means for removably connecting the covering to the cabinet; said attachment means comprising an additional groove in each of the sidewalls and a plurality of strips which are connectable to the covering and insertable into said additional grooves.

2. The cabinet of claim 1 wherein the additional grooves are located in the said edges of the sidewalls.

3. The cabinet of claim 1 wherein the cabinet further includes means for removably attaching the cabinet to a table, said means comprising a support ledge that is slidably received within a transverse groove of each said wall and a plurality of C-shaped clamps for clamping said support ledge to said table.

* * * * *